US009573656B2

(12) United States Patent
Templeman

(10) Patent No.: US 9,573,656 B2
(45) Date of Patent: Feb. 21, 2017

(54) HYDROFOIL BOAT STABILIZER

(71) Applicant: MARINE DYNAMICS, INC., Lenexa, KS (US)

(72) Inventor: Jon Templeman, Lenexa, KS (US)

(73) Assignee: MARINE DYNAMICS, INC., Lenexa, KS (US)

( * ) Notice: Subject to any disclaimer, the term of this patent is extended or adjusted under 35 U.S.C. 154(b) by 0 days.

(21) Appl. No.: 14/415,497

(22) PCT Filed: Jul. 16, 2013

(86) PCT No.: PCT/US2013/050714
§ 371 (c)(1),
(2) Date: Jan. 16, 2015

(87) PCT Pub. No.: WO2014/014932
PCT Pub. Date: Jan. 23, 2014

(65) Prior Publication Data

US 2015/0128841 A1 May 14, 2015

Related U.S. Application Data

(60) Provisional application No. 61/671,870, filed on Jul. 16, 2012.

(51) Int. Cl.
*B63B 1/24* (2006.01)

(52) U.S. Cl.
CPC *B63B 1/24* (2013.01); *B63B 1/242* (2013.01)

(58) Field of Classification Search
CPC ..... B63B 1/24; B63B 1/242; B63B 1/246; B63B 1/248
USPC ..... 114/274
See application file for complete search history.

(56) References Cited

U.S. PATENT DOCUMENTS

| | | | |
|---|---|---|---|
| 3,433,195 | A | 3/1969 | Poole |
| 4,487,152 | A | 12/1984 | Larson |
| 2009/0314195 | A1 | 12/2009 | Templeman et al. |
| 2011/0315063 | A1 | 12/2011 | Templeman et al. |

OTHER PUBLICATIONS

International Search Report and Written Opinion from PCT Publication No. WO2014/014932 (dated Dec. 12, 2013).

*Primary Examiner* — Anthony Wiest
(74) *Attorney, Agent, or Firm* — Hovey Williams LLP

(57) ABSTRACT

A hydrofoil having an integrated yoke-bridge to preclude expansion of the channel defined by the yoke when the hydrofoil is secured to the cavitation plate. The single piece hydrofoil is secured to the cavitation by lateral screws passing through the hydrofoil and engaging the side of the cavitation plate. Additionally, one or two holes are optionally drilled through the single piece hydrofoil and through the cavitation plate followed by insertion of bolts passing through the hydrofoil and the cavitation plate.

9 Claims, 12 Drawing Sheets

HYDROFOIL BOAT STABILIZER

RELATED APPLICATION

This is a National Phase Application pursuant to 35 U.S.C. §371 of International Application No. PCT/US2013/050714, filed Jul. 16, 2013, claiming priority from U.S. Provisional Patent Application No. 61/671,870; filed Jul. 16, 2012, the entire disclosures of both of which are hereby incorporated by reference herein.

BACKGROUND

The present invention relates to a hydrofoil boat stabilizer having a true lifting airfoil/hydrofoil shape incorporated into the design, which provides lift to the stern of the boat. The hydrofoil boat stabilizer is attachable to a cavitation plate on the lower drive unit of a boat motor.

The skilled artisan understands that the drive system of a boat generates the forward thrust. The same skilled artisan also understands that the boat and drive system are fighting the forces of drag upon the boat as it rides low in the water. Thus, the higher in the water, or "on the plane," a boat rides, the less drag it encounters. Therefore, it is desirable to reduce the amount of boat drag.

Many forces exert drag on a boat. In particular, the greater degree of boat hull in contact with water increases drag. Therefore, getting a boat on plane faster will decrease drag. Providing lift to the lower drive unit will help get a boat on plane; however, stabilizers commonly used to lift the drive unit also introduce additional drag.

SUMMARY

In one embodiment, the current invention provides a single piece hydrofoil. The single piece hydrofoil comprises a yoke and a pair of wings. The yoke includes a center body defining a longitudinal channel therein. The longitudinal channel has a first and second side, and is open to the front of the center body. The yoke also includes a pair of open-ended slots oppositely disposed in each of the channel sides, and extending along a substantial length of the sides. The open-ended slots are capable of receiving a cavitation plate of a boat motor. Thus, when installed, the single piece hydrofoil has a top portion above the cavitation plate and a bottom portion below the cavitation plate. The bottom portion of the single piece hydrofoil includes no more than two dimples or drill bit centering recesses. The yoke includes a tail section integrally formed with the center body. The tail section covers a portion of the longitudinal channel. The yoke includes a contoured trailing edge defined by the tail section. The contoured trailing edge angles upwardly. The pair of wings are integrally joined with the yoke and project outwardly therefrom. Each of the wings has a leading edge and a trailing edge. The trailing edges of the wings are seamlessly integrated with the contoured trailing edge of the tail section. Two non-invasive securing devices passing through the slots and contacting, but not penetrating, the cavitation plate thereby securing the slip-on hydrofoil to a cavitation plate. Additionally, an integrated yoke-bridge positioned near the opening of the longitudinal channel maintains the preferred gap of the longitudinal channel defined by the yoke following attachment of the slip-on hydrofoil on the cavitation plate.

In another embodiment, the above described single piece hydrofoil also includes one or two securing devices such as screws or bolts pass through the single piece hydrofoil and the cavitation plate. The combination of the non-invasive securing devices, the one or two screws or bolts and the yoke bridge cooperate to retain the single piece hydrofoil on the cavitation plate. To aid in position of the screws or bolts, drill bit centering recesses act as a guide for drilling through the single piece hydrofoil and the cavitation plate.

BRIEF DESCRIPTION OF THE DRAWINGS

FIG. 3 is a top perspective view of another embodiment of the single piece hydrofoil depicting the optional drag reducing surface.

FIG. 8 is a rear view of the hydrofoil.

DETAILED DESCRIPTION

Figure 7:
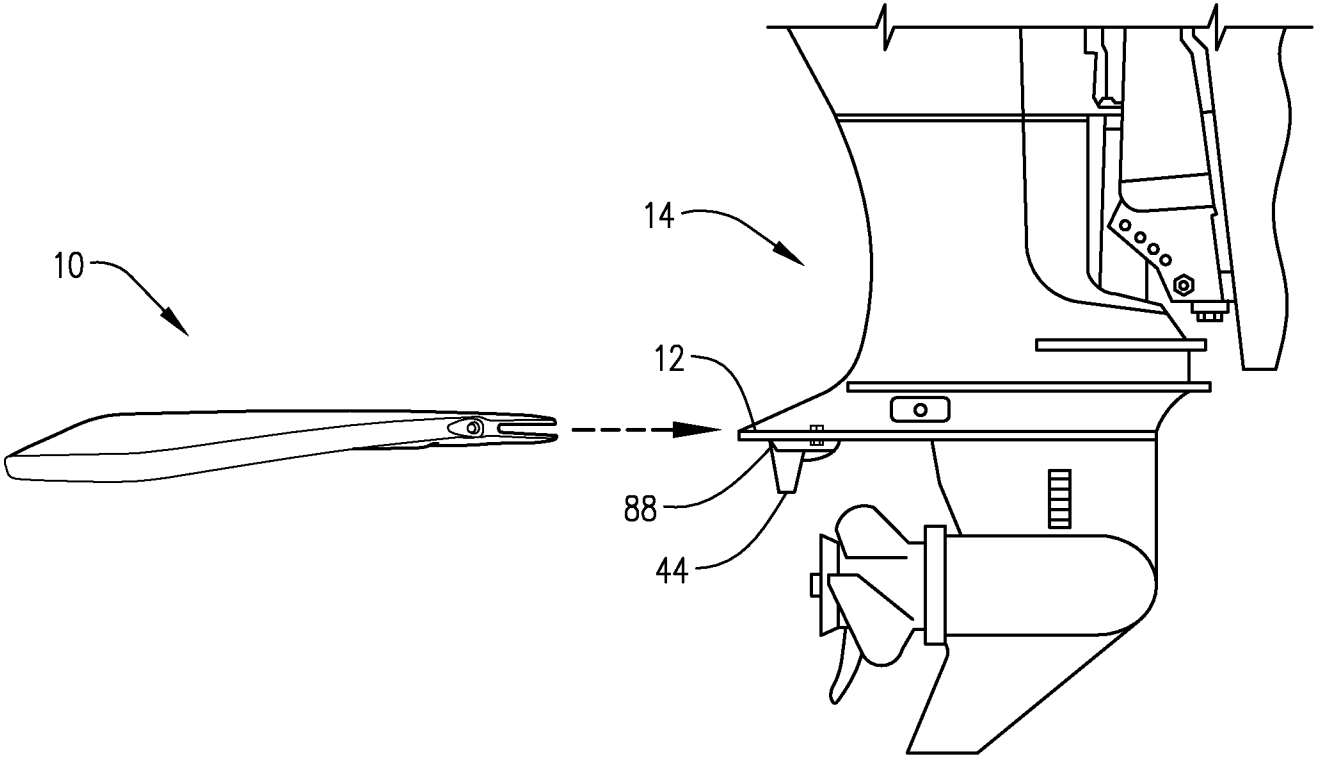
FIG. 7 is a side view of a hydrofoil positioned adjacent to the lower drive unit of a boat motor and depicting the cavitation plate.
Figure 5:
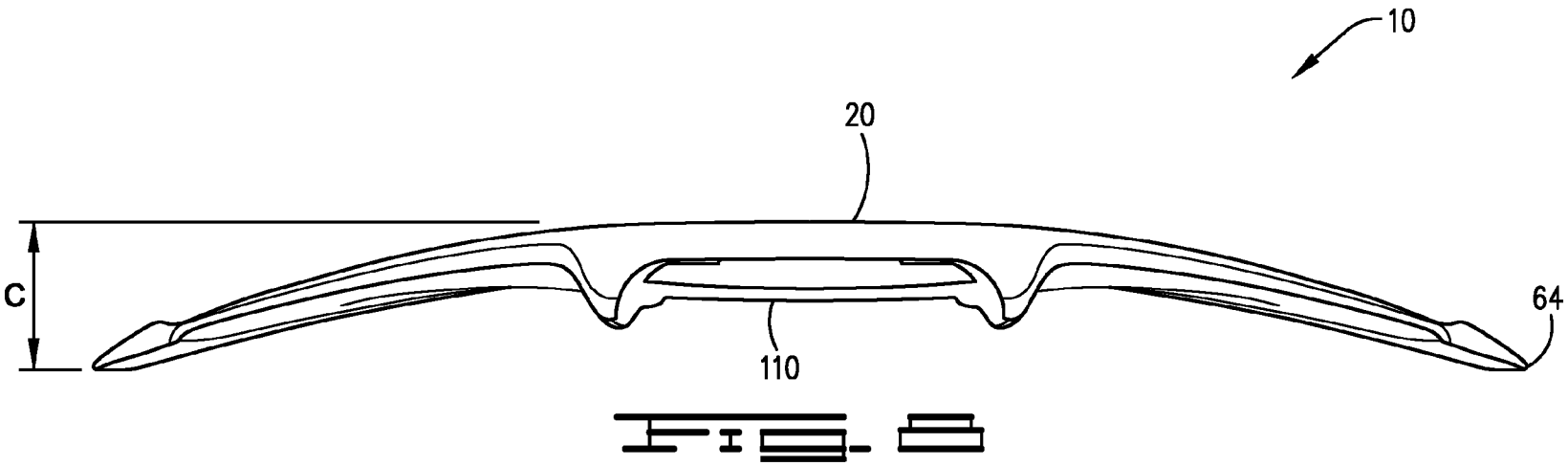

Referring to the FIGS, the single piece hydrofoil is illustrated and generally designated by the numeral 10. Hydrofoil 10 is a single piece hydrofoil having minimum cavitation with low-drag characteristics. With reference to FIG. 7, depending on the configuration of the cavitation plate, positioning of hydrofoil 10 on a cavitation plate 12 of lower drive unit 14 of a boat motor will require initial removal of the torque tab or sacrificial anode. As depicted in the FIGS, hydrofoil 10 is the combination of yoke 16 and wings 18. Yoke 16 is designed to fit around cavitation plate 12 and lower drive unit 14 of a boat motor. Thus, the single piece hydrofoil extends above and below the cavitation plate. With reference to FIG. 3, an integral yoke-bridge 110 spans the opening of the yoke to maintain the desired gap defined by opposing sidewalls 36 and 38 (also referred to as channel first side 36 and channel second side 38). Typically, integral yoke-bridge 110 will be located on the bottom side 34 of hydrofoil 10.

Figure 5:
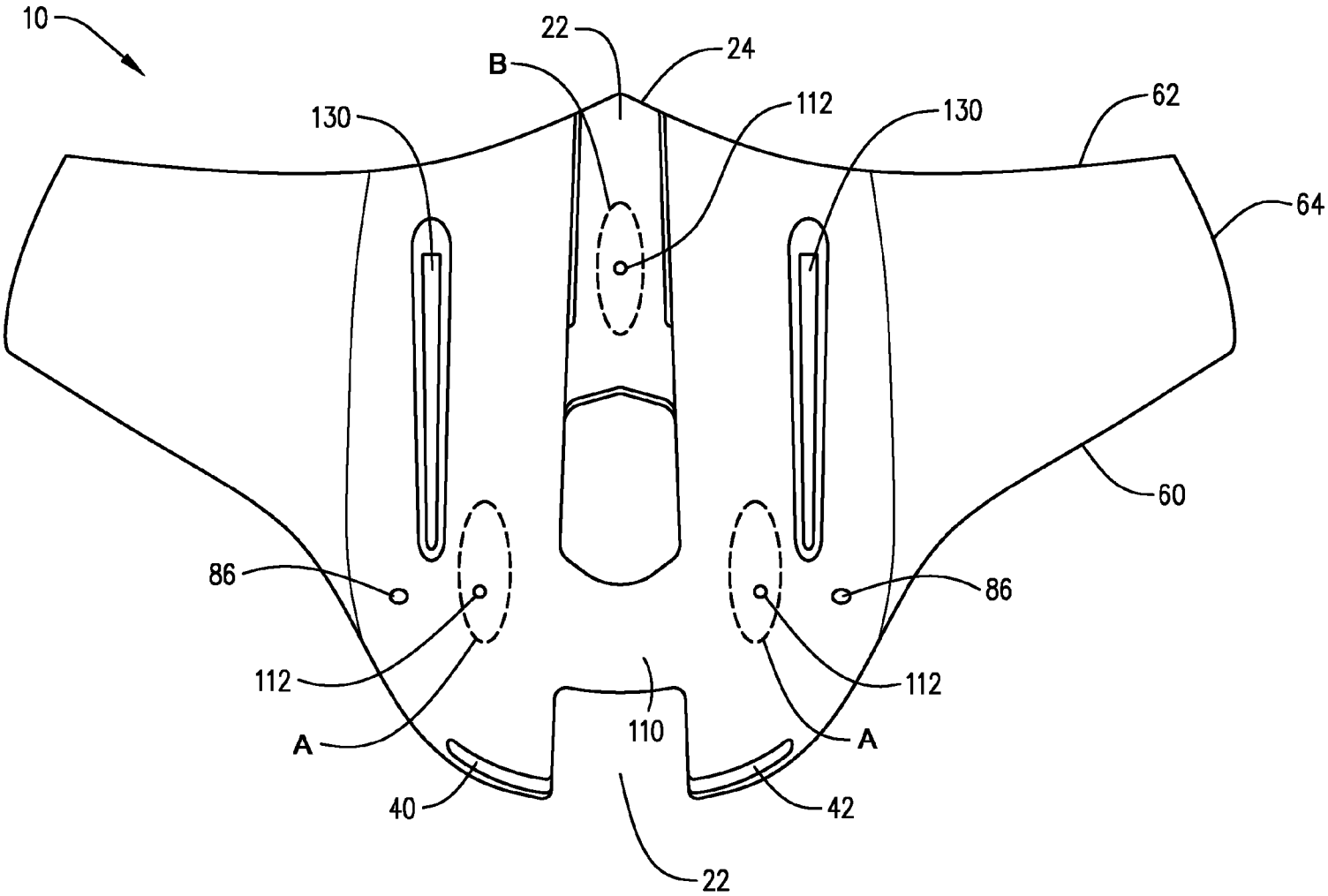
FIG. 5 is a bottom view of the single piece hydrofoil with integrated yoke-bridge depicting the location of the optional drill bit centering recesses.
Figure 5:
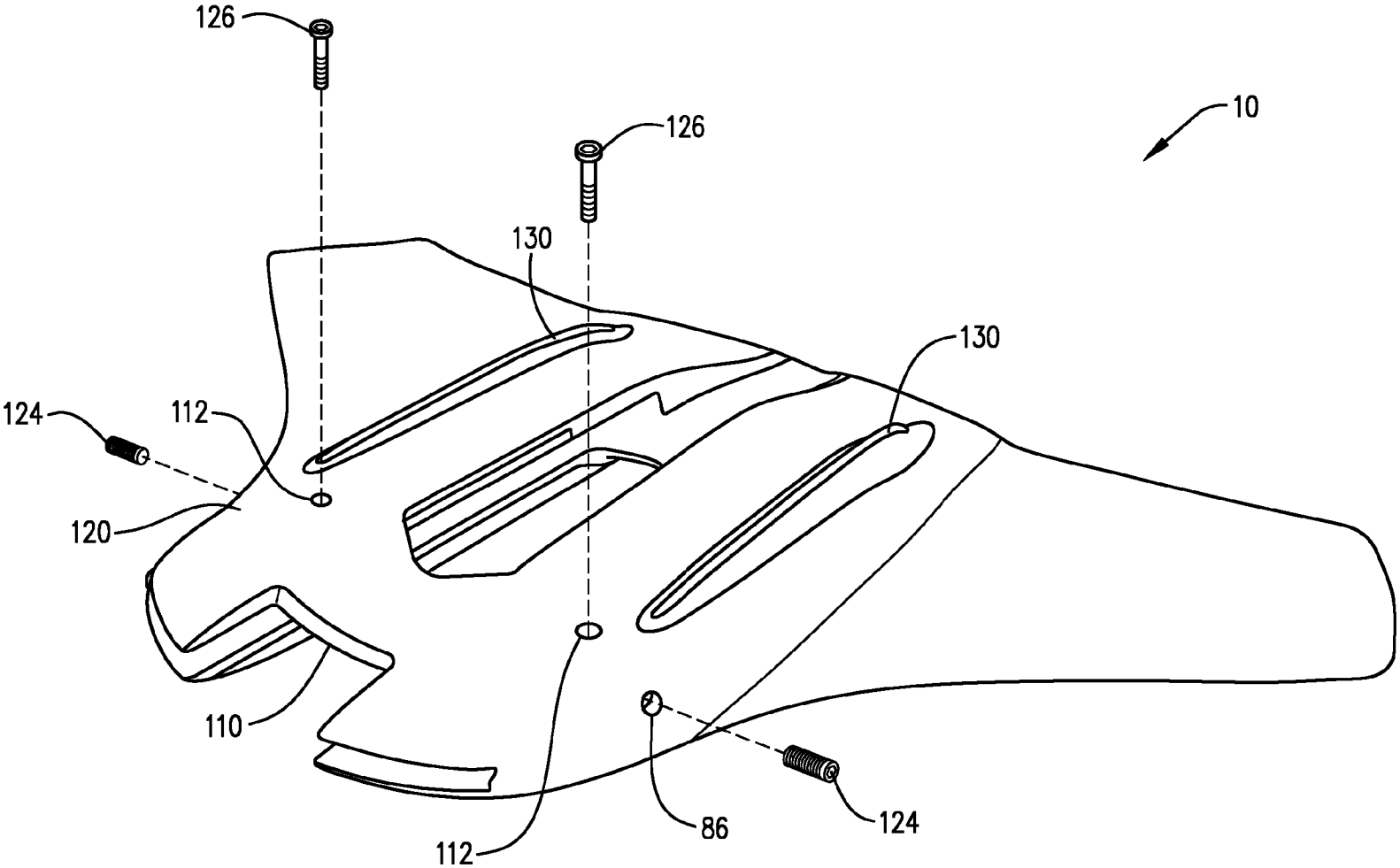

As depicted in FIG. 5, the face of bottom 34 will have from one to three dimples or drill bit centering recesses 112. Drill bit centering recesses will typically be located in the regions designated with the letters [A] and [B]. Drill bit centering recesses 112 provide guidance when drilling through hydrofoil 10 and cavitation plate 12. Holes drilled through hydrofoil 10 and cavitation plate 12 permit positioning of bolts 126 through hydrofoil 10 and cavitation plate 12 thereby securing hydrofoil 10 to cavitation plate 12. A bolt particularly suited for this application is a crown type carriage bolt having a domed head. As discussed below, no more than two bolts 126 will be required to secure single piece hydrofoil 10 to the cavitation plate. Thus, no more than two holes will be drilled through the cavitation plate.

Figure 6:
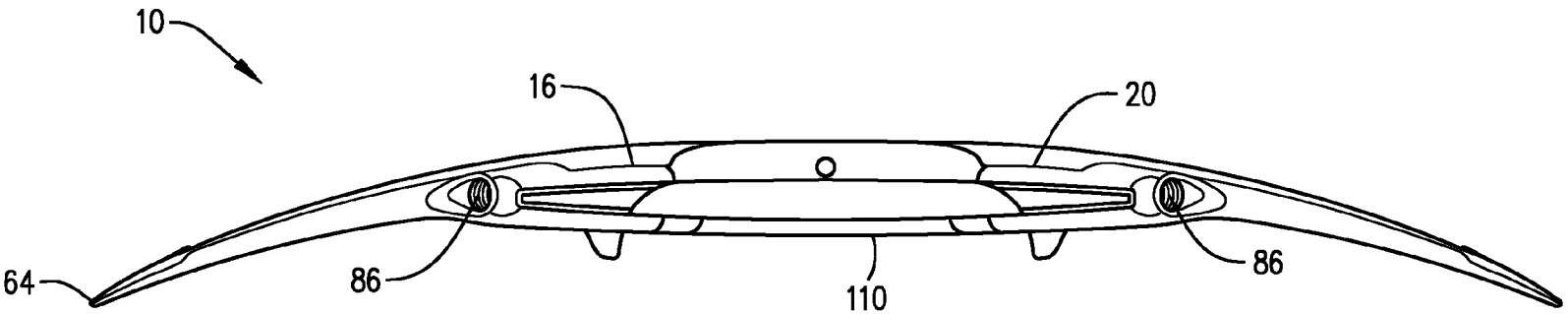
FIG. 6 is a bottom perspective view showing the securing devices.
Figure 10:
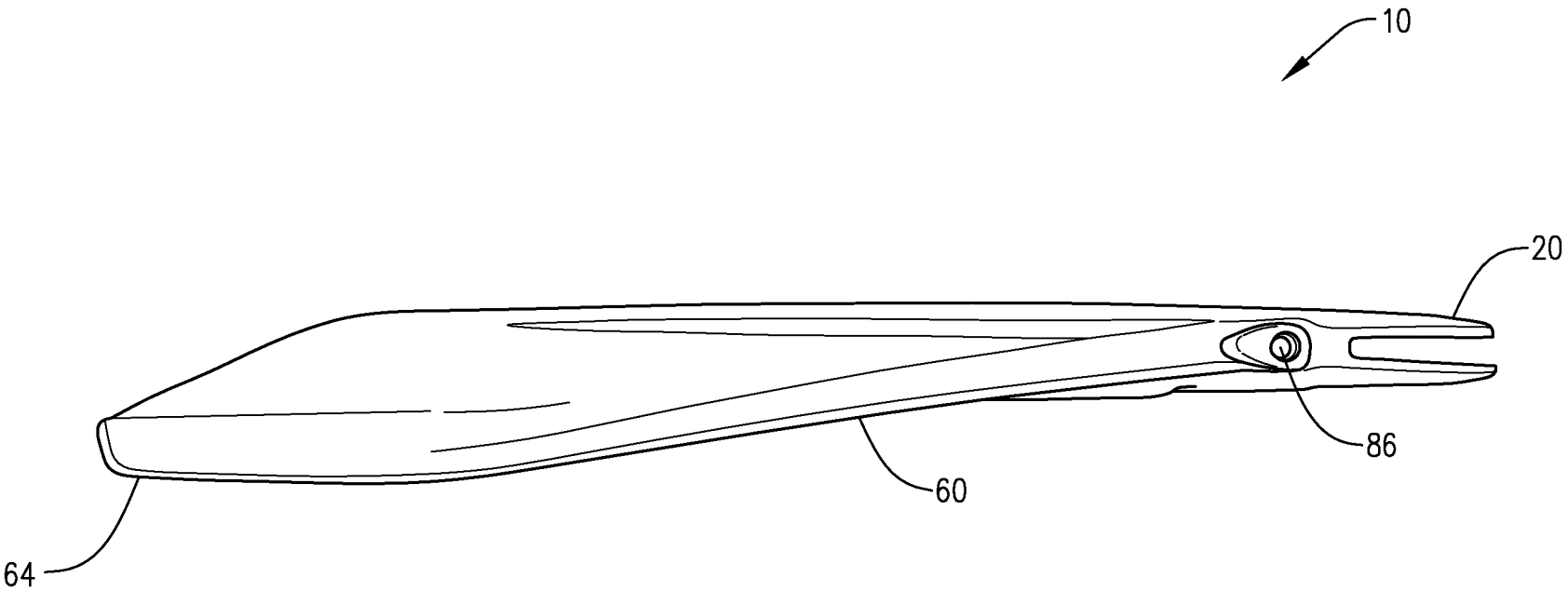
FIG. 10 is a side view of the hydrofoil.

Single piece hydrofoil 10 is secured to the cavitation plate by a combination of elements. In view of the integrated yoke-bridge 110, the cavitation plate must be removed from the motor and positioned within longitudinal channel 22. The cavitation plate will slide into opposing sidewall slots 40 and 42. Longitudinal channel 22 and slots 40, 42 are depicted in FIG. 3. As depicted in the FIGS., the cavitation plate resides within single piece hydrofoil 10 such that hydrofoil 10 extends above and below the cavitation plate. Once positioned, securing devices 124 can be tighten sufficiently to engage the edge of the cavitation plate. As depicted in FIG. 6 and discussed in more detail below, securing devices 124 pass through threaded holes 86 and contact the edge of cavitation plate 12.

Over-tightening of securing devices 124 can place undue stress on yoke 16 by increasing the gap defined by sidewalls 36 and 38 potentially leading to premature failure of hydrofoil 10. Integral yoke-bridge 110 counters the tendency of users to over-tighten securing devices 124 and substantially precludes expansion of the gap between sidewalls 36 and 38 thereby maintaining the desired dimensions of longitudinal channel 22.

In addition to securing devices 124, one or two bolts 126 passing through hydrofoil 10 and the cavitation plate serve to secure single piece hydrofoil 10 to the cavitation plate. In the configuration depicted in the FIGS., no more than two bolts 126 will be required to adequately secure hydrofoil 10 to the cavitation plate. Thus, the cooperation of bolts 126, securing devices 124 and integrated yoke-bridge 110 retain hydrofoil 10 to the cavitation plate.

Optionally a single bolt 126 positioned generally in region [B] depicted in FIG. 5 will be sufficient, in cooperation with securing devices 124 and integrated yoke-bridge 110, to retain hydrofoil 10 to the cavitation plate. U.S. patent application Ser. No. 12/826,412, filed on Jun. 29, 2010 and published as U.S. Pub. No. 2001/0315063 on Dec. 29, 2011, incorporated by reference herein, discloses a similar hydrofoil lacking the yoke-bridge improvement of the current invention.

Figure 1A:
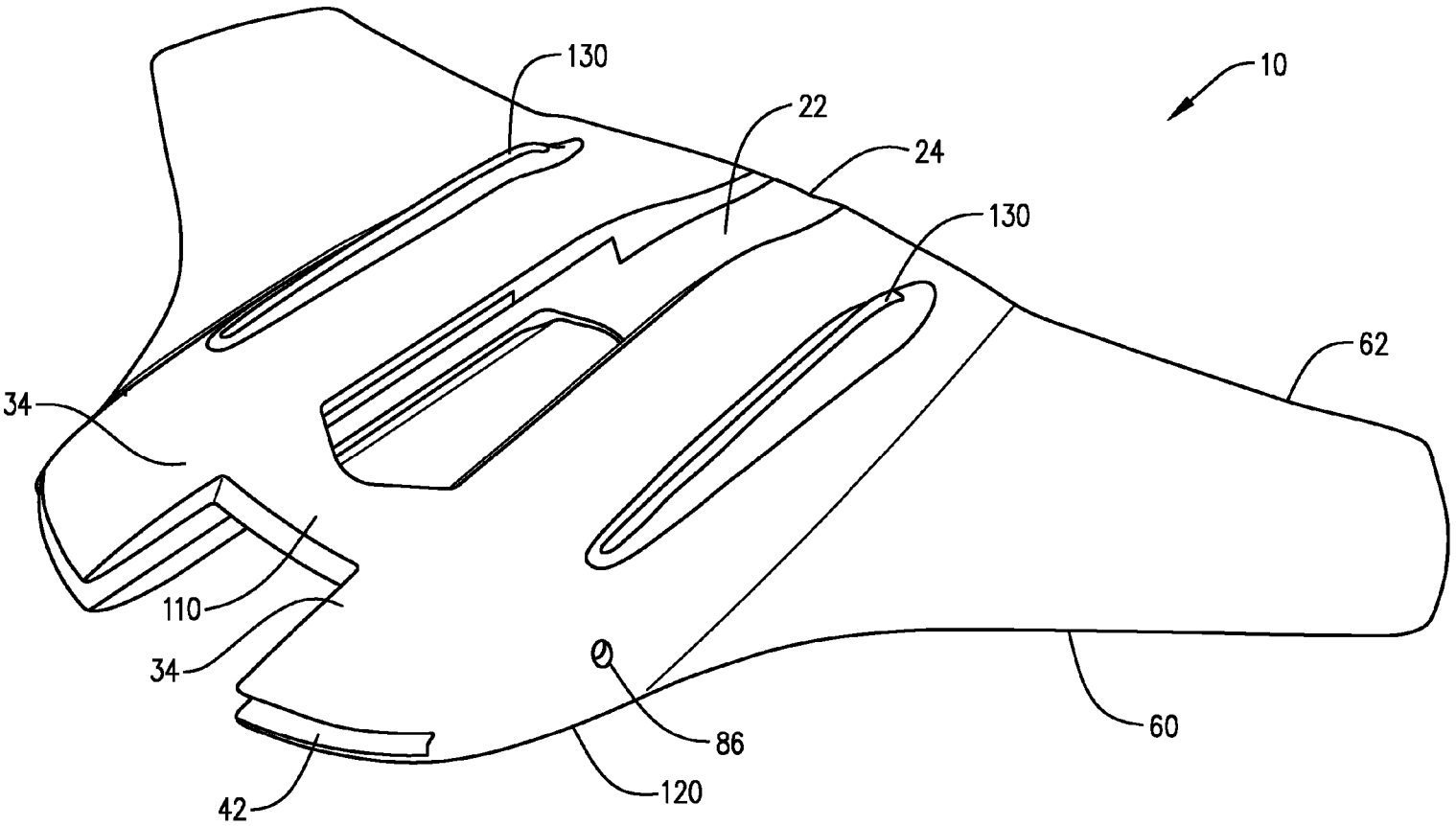
FIG. 1*a* is a bottom perspective view of one version of the single piece hydrofoil.
Figure 1:
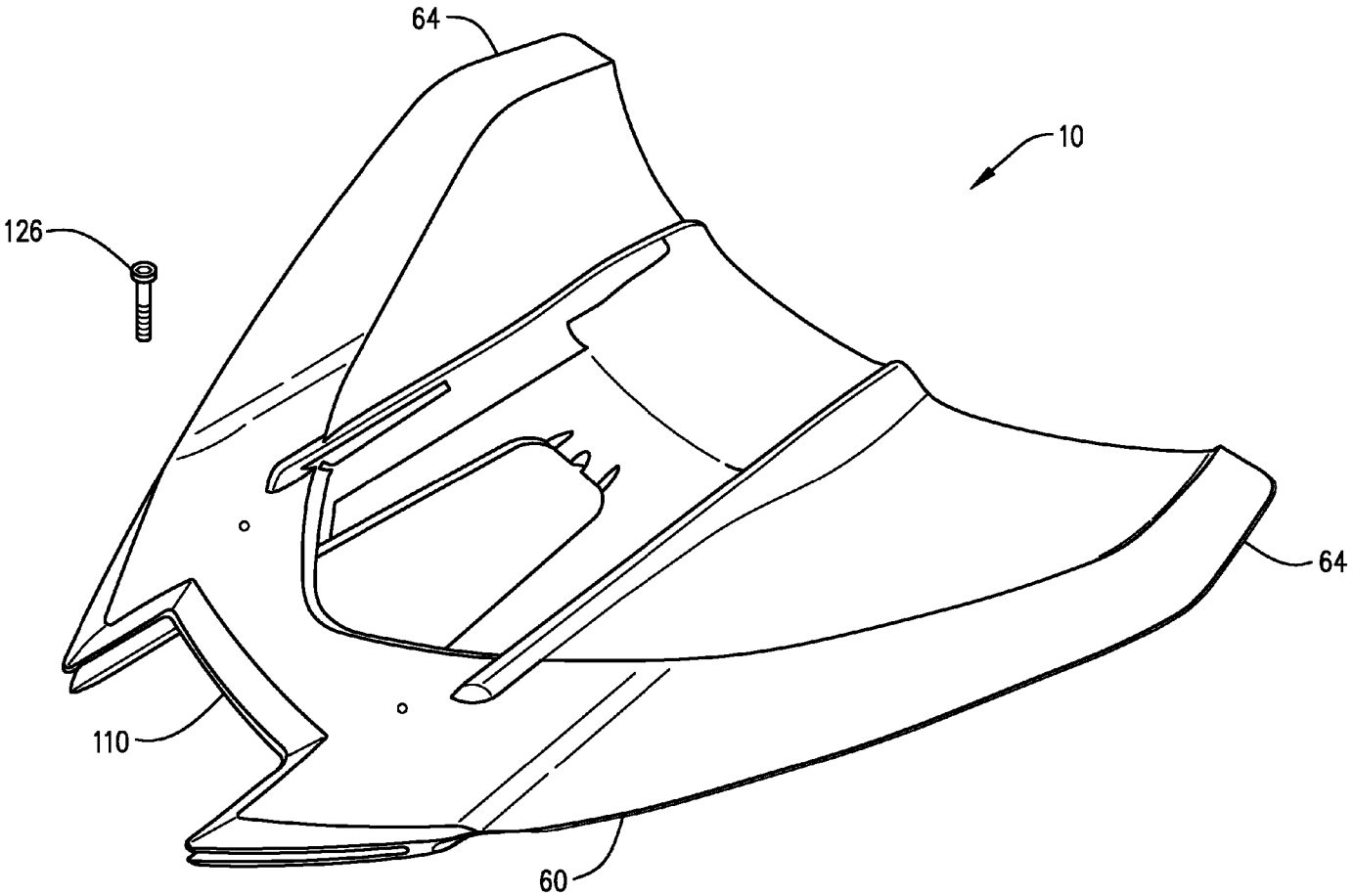
FIG. 1*b* is a bottom perspective view of another version of the single piece hydrofoil.
FIG. 1*c* is a bottom view of the single piece hydrofoil.
Figure 1C:
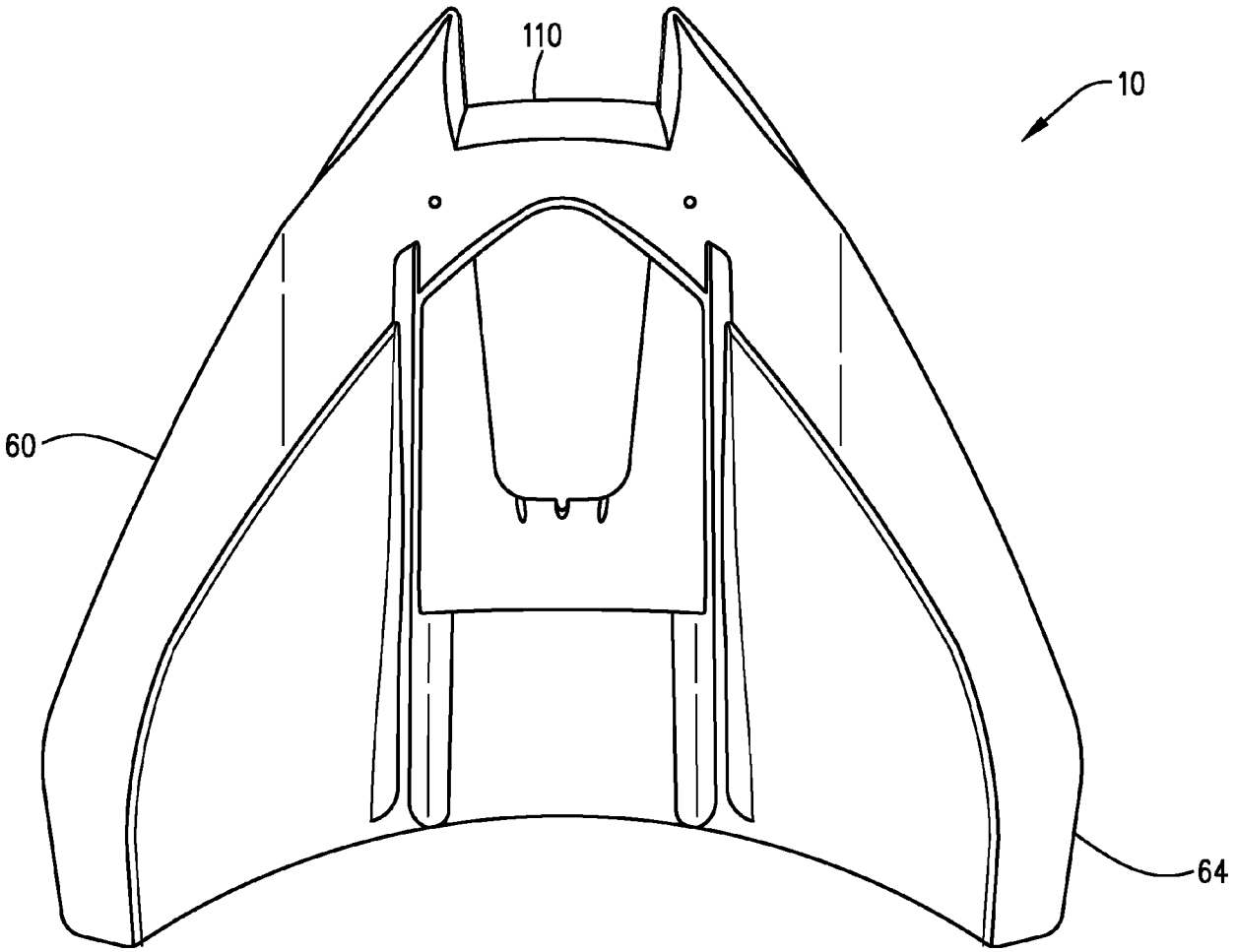
Figure 2A:
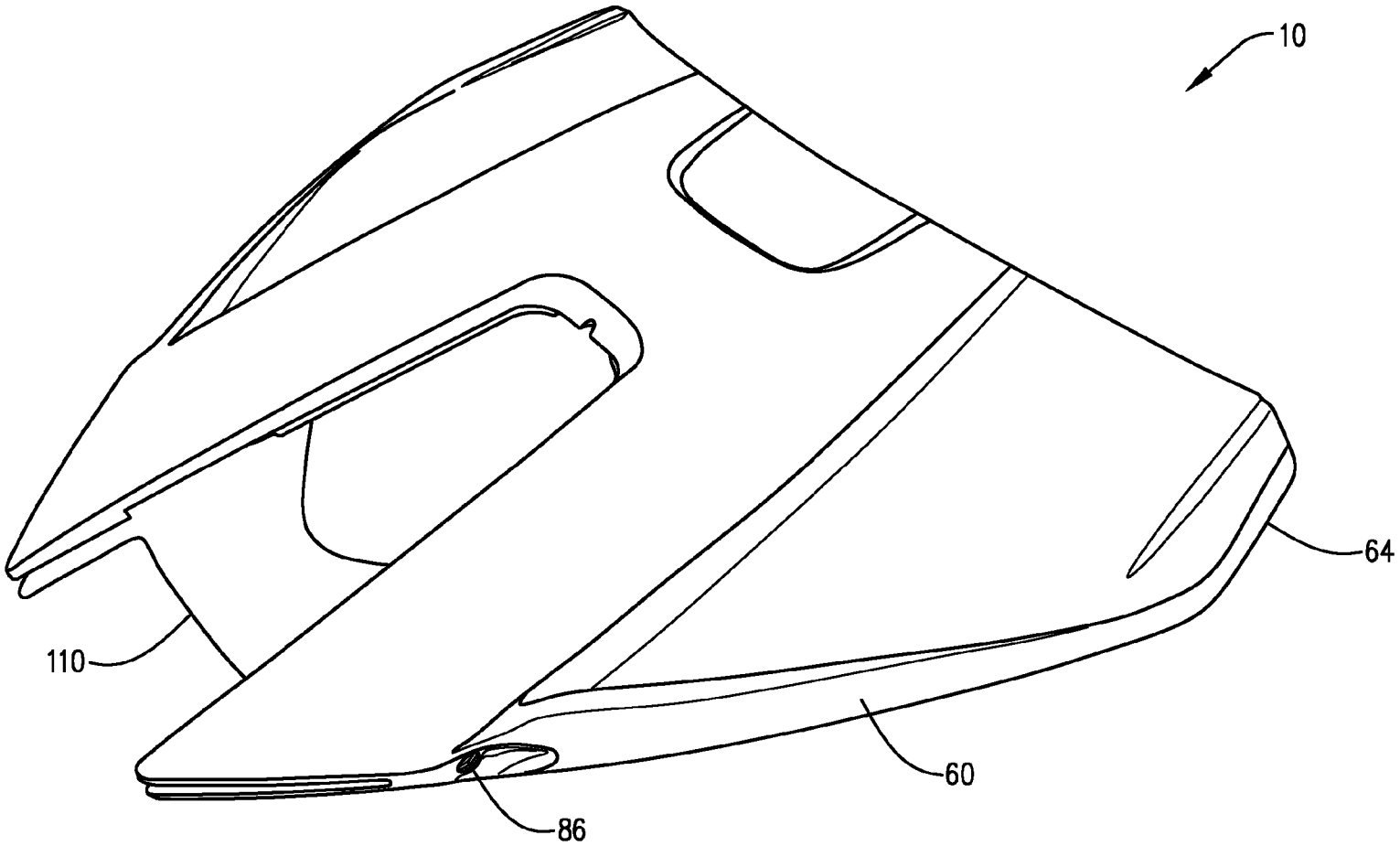
FIGS. 2*a* and 2*b* are top perspective views.
Figure 2E:
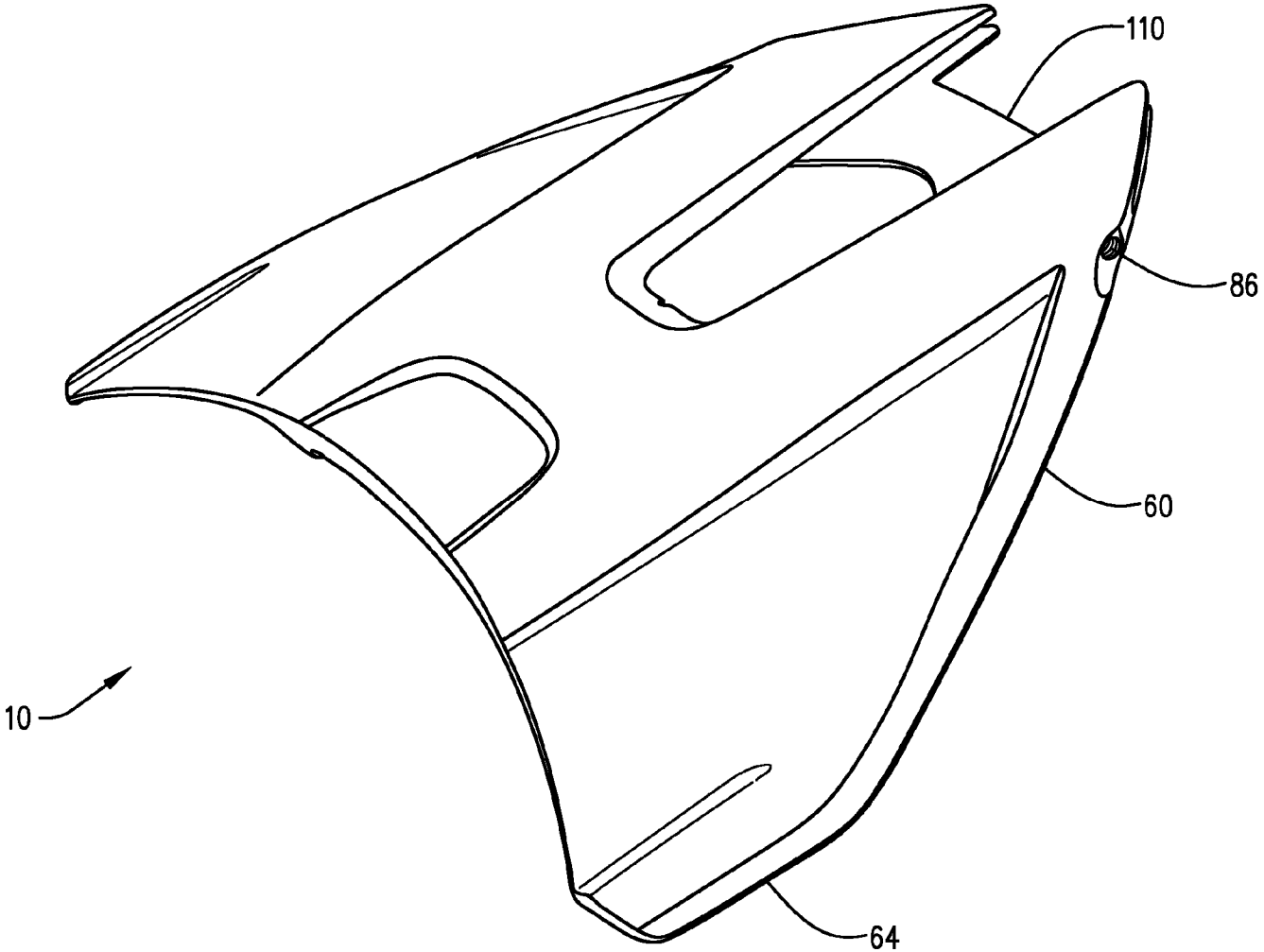
Figure 9:
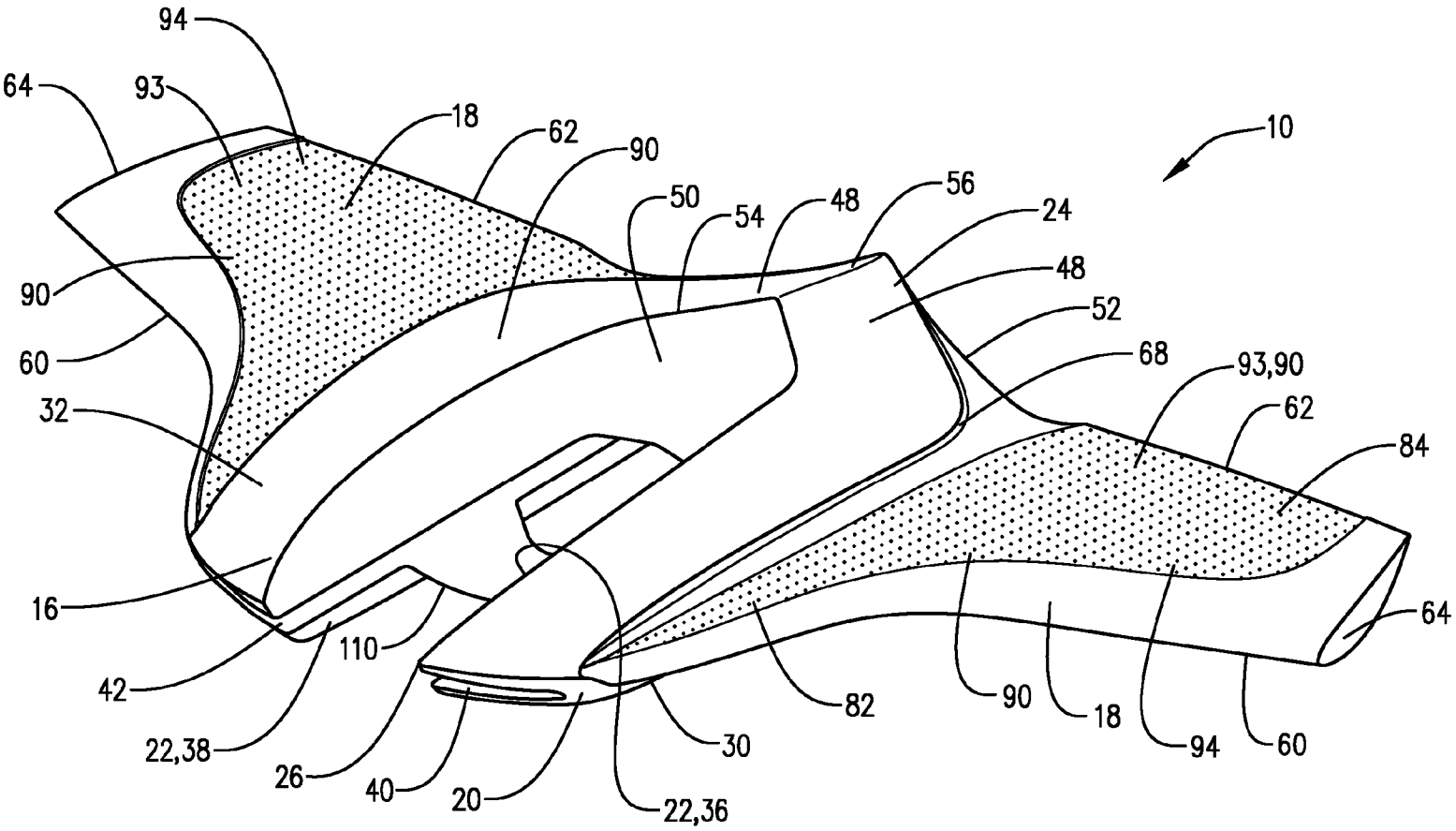
FIG. 9 is a front view of the hydrofoil depicting the curvature of the wings.

Regarding FIGS. 1-3, yoke 16 includes center body 20, longitudinal channel 22, and tail section 24. Yoke 16 also includes front 26, aft 28, sides 30, top 32 and bottom 34 of center body 20. Front 26, aft 28 and sides 30 all typically have rounded edges transitioning to bottom 34. As best depicted in FIG. 8, the curvature or drop from the center line of top 32 of center body 20 to outer edge of wing tip 64 will be from zero inches to about two inches as depicted by dimension [C] in FIG. 8. Preferably, the drop from center to tip is on a radius or curvature. Additionally, front 26 and aft 28 are sloped towards sides 30, thereby reducing drag around yoke 16. One preferred embodiment positions integrated yoke-bridge 110 on bottom 34 near the forward open end of yoke 16 as depicted in FIG. 1*a*. However, integrated yoke-bridge 110 may be optionally located on top 32 in a similar configuration.

Yoke 16 defines longitudinal channel 22 within center body 20. Longitudinal channel 22 opens to front 26 and aft 28. Longitudinal channel 22 has channel first side 36 and channel second side 38, which are oppositely positioned walls. Open-ended slots 40 and 42 are disposed in channel first and second sides 36 and 38, respectively. Open-ended slots 40 and 42 are oppositely positioned from each other. As illustrated, open-ended slots 40 and 42 are approximately centered on channel sides 36 and 38. However, open-ended slots 40 and 42 may be positioned above or below the depicted location by as much as about 25 percent without significant degradation to hydrofoil 10 performance.

Referring to FIGS. 1-3, open-ended slots 40 and 42 are capable of receiving cavitation plate 12. As illustrated, open-ended slots 40 and 42 extend along a substantial length of channel first and second sides 36 and 38, terminating near aft 28 of center body 20 at slot wall 46. Slot wall 46 provides a receiving block for cavitation plate 12 that prevents cavitation plate 12 from moving aft-wardly in open-ended slots 40 and 42 once hydrofoil 10 is slipped thereon.

Extending from yoke 16 onto contoured flow surface area 48 of tail section 24 of hydrofoil 10 is yoke drag relief 50. Yoke drag relief 50 is wedge-like in its shape. Yoke drag relief 50 eliminates hydraulic impingement on hydrofoil 10 at the point where the water flow departs from cavitation plate 12 and lower drive unit 14 of a boat motor. Thus, yoke drag relief 50 reduces the drag acting upon hydrofoil 10.

Referring to FIGS. 1-3 tail section 24 is integrally formed with yoke 16 across top 32 and center body 20 towards aft 28. Tail section 24 provides the connective support structure for yoke 16. A portion of tail section 24 covers longitudinal channel 22. Tail section 24 terminates beyond aft 28 of yoke 16 at contoured trailing edge 52. Near the forward end of yoke 16, integrated yoke-bridge 110 spans longitudinal channel 22. Integrated yoke-bridged 110 provides structural support to hydrofoil 10 thereby enhancing structural integrity following attachment of hydrofoil 10 to cavitation plate 12. Yoke-bridge 110 substantially precludes expansion of longitudinal channel 22 due to over-tightening of set-screws 124 or other securing devices 124 passing through threaded holes 86.

The portion of longitudinal channel 22 covered by tail section 24 is preferably about one-half of the total length of yoke 16 and tail section 24 combined, or less. As illustrated in FIGS. 1-3, tail section 24 may cover a small portion of longitudinal channel 22 and open-ended slots 40 and 42.

Tail section 24 includes yoke drag relief 50. Yoke drag relief 50 provides for transition of fluid, such as water, from cavitation plate 12 and lower drive unit 14 of a boat motor over transition flow edge 54, and onto and along contoured flow surface area 48 and spine 56. Transition flow edge 54 is the transition point from yoke drag relief 50 and contoured flow surface area 48 and spine 56. Contoured flow surface area 48 and spine 56 provide water flow onto and over contoured trailing edge 52. Both contoured flow surface area 48 and spine 56 terminate at contoured trailing edge 52.

Extending from bottom 34 at aft 28 is upward sloping bottom 58 of tail section 24. With reference to FIG. 3, contoured flow surface area 48 and upward sloping bottom 58 join together to form contoured trailing edge 52. Contoured trailing edge 52 is the juncture of contoured flow surface area 48 and upward sloping bottom 58. Contoured flow surface area 48 provides an upwardly angling flow direction as it approaches contoured trailing edge 52. Similarly, upward sloping bottom 58 provides an upwardly angling flow direction as it approaches contoured trailing edge 52. Upward sloping bottom 58 has a steeper upward slope than that of contoured flow surface area 48. The resulting flow of water, departing contoured trailing edge 52, has an overall reduction of turbulence, which in turn reduces the cavitation and drag imparted to hydrofoil 10.

As illustrated in FIG. 3, wings 18 have leading edge 60, trailing edge 62, wing tip 64 and root 66. Wings seamlessly and integrally join with yoke 16 at root 66. In particular, wings integrally join with center body 20 at root 66 and form upper flow channel 68 where upper surface of wings 18 join top 32 of yoke 16. Upper flow channel 68 channels water in the transition zone between wing root 66 and yoke 16 towards aft 28 and tail section 24. Seamless integration of trailing edge 62 and contoured trailing edge 52 helps to maintain laminar flow of water over trailing edge 62 and contoured trailing edge 52. Thus, the seamless integration of trailing edge 62 and contoured trailing edge 52 provides for a low-drag release of the water from the hydrofoil tail section thereby minimizing drag.

Figure 4:
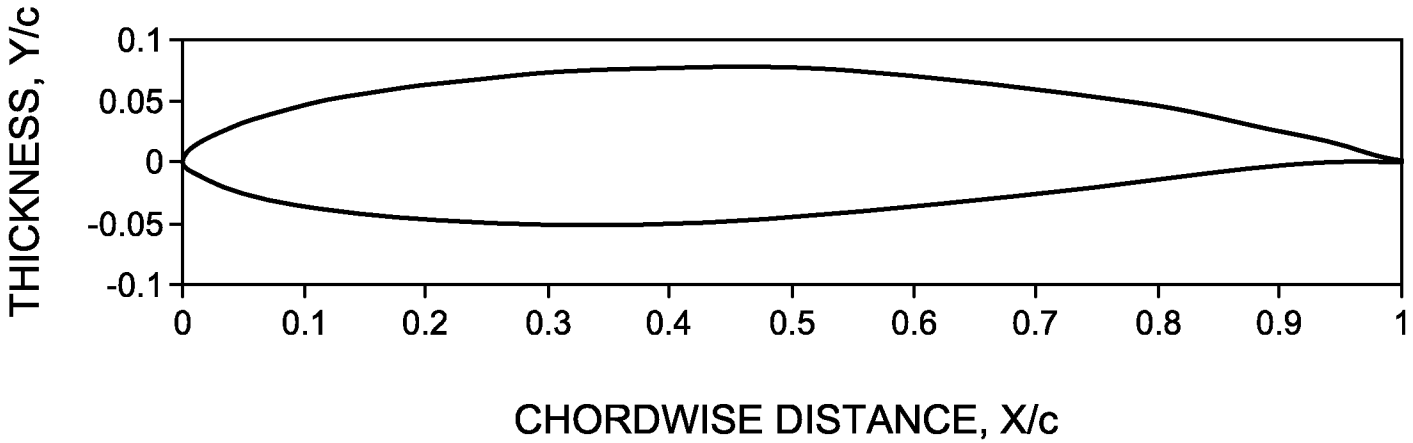
FIG. 4 is a cross-sectional depiction of a true hydrofoil.

As illustrated in FIG. 4, wings 18 have cross-sectional shape 70 that is the configuration of a true hydrofoil. Non-limiting examples of true hydrofoils include hydrofoils having the designation of NACA 63-209, Eppler E817, Eppler E818, Eppler E836, Eppler 837, Eppler E838, Eppler E874, Eppler E904, Eppler E908, and Speers H105. Some of the decision parameters used to select the true hydrofoil are based upon the speed, lift, and drag characteristics for which the hydrofoil will be utilized. In one preferred embodiment, the Speers H105 hydrofoil shape satisfies all of the desired characteristics of lift and drag for the different speeds hydrofoil 10 is to operate.

Preferably, wings 18 continuously retain the cross-sectional configuration of the true hydrofoil from wing tip 64 through root 66, including a plurality of angles of attack, but at least one angle of attack. Alternatively, the true hydrofoil shape transitions from a first true hydrofoil shape to at least one other true hydrofoil shape for each angle of attack based upon the broad spectrum of performance parameters desired for hydrofoil 10. Thus, wings 18 provide for at least one lifting segment having at least one angle of attack.

As illustrated in FIGS. 1-3, wings 18 have a swept-back configuration. Near root 66, wings 18 have forward section 82 seamlessly extending from yoke 16. Forward section 82 sharply sweeps back from yoke 16 towards aft 28, and transitions into outer section 84 near transition point 80.

Securing devices 124 pass through threaded holes 86 and contact cavitation plate 12 positioned within longitudinal channel 22. Securing devices 124 may be set-screws or other similar low-profile devices. As illustrated in the FIGS., each side of yoke 16 has at least one threaded hole 86 passing through center body 20. Typically, a single threaded hole 86 per side will suffice as a single securing device per 124 passing through one threaded hole 86 per side, in conjunction with one or two bolts 126 and integrated yoke-bridge 110, will apply sufficient force to secure hydrofoil 10 to cavitation plate 12. As depicted in the FIGS., with hydrofoil 10 positioned on cavitation plate 12, threaded holes 86 align with edge 88 of cavitation plate 12. Thus, when installed, securing devices 124 engage edge 88 thereby non-invasively securing yoke 16 to cavitation plate 12.

The configuration of integrated yoke-bridge 110 substantially precludes over-tightening of securing devices 124. In the absence of integrated yoke bridge 110, single piece hydrofoils generally require at least four bolts passing through the cavitation plate to adequately secure a hydrofoil to the cavitation plate. Alternatively, in the absence of bolts passing through the hydrofoil and cavitation plate, users are prone to over-tightening of securing devices 124 thereby placing unopposed force cavitation plate 12. The unopposed force translates to threads 87 within holes 86 thereby increasing the distance between opposing sidewalls 36 and 38 until the installer no longer tightens securing devices 124. Unfortunately, increasing the distance between sidewalls 36 and 38 places stress on the overall structure of hydrofoil 10. However, integrated yoke-bridge 110 opposes the outward force resulting from tightening of securing devices 124 passing through threaded holes 86 and contacting cavitation plate 12. Further, integrated yoke-bridge 110 reduces the likelihood of over-tightening securing devices 124 within threaded holes 86. Since integrated yoke-bridge 110 opposes or limits separation of opposing sidewalls 36 and 38, tightening of securing devices 124 applies increased force to cavitation plate 12. Thus, yoke-bridge 110 allows the installer to sense the increase in torque when tightening securing device 124 without spreading of yoke 16. Thus, integrated yoke-bridge 110 maintains the designed separation of opposing sidewalls 36 and 38 and enhances the structural integrity of hydrofoil 10.

As depicted in FIG. 3, exposed outer surface 90 of hydrofoil 10 may have an optional textured surface 93. The preferred texturing helps maintain laminar flow by reducing the magnitude of turbulent separation of the water from exposed outer surface 90. The reduced magnitude of the turbulent separation also reduces the localized drag experienced by hydrofoil 10. In one optional embodiment, exposed outer surface 90 has a plurality of extremely small outward projections 93 that have varying height and placement across exposed outer surface 90, thereby creating the drag reducing surface 93. Drag reducing surface 93 is analogous to the denticles found on sharkskin. Preferably, drag reducing texture 93 of exposed outer surface 90 is molded directly into surface 90; however, but it may also be applied thereto.

If desired, the entire exposed outer surface 90 of hydrofoil 10 may have drag reducing texture 93. Alternatively, only particular segments of hydrofoil 10 may have drag reducing texture 93. For example, drag reducing texture 93 on exposed outer surface 90 may be limited to upper surface 92 of tail section 24 and to wing upper surface 94 of wings 18.

Optionally, hydrofoil 10 may also include a pair of stabilizing fins 130 positioned on bottom 34. Preferably, stabilizing fins 130 are molded directly into hydrofoil 10.

During operation of a boat having hydrofoil 10 installed thereon, water flowing over hydrofoil 10 transitions between laminar and turbulent. Turbulent flow creates drag and increases the profile drag, thereby reducing the performance of hydrofoil 10. By using wings 18 with a cross-sectional shape configuration of the true hydrofoil, such as the Speers H105, the transition phase of the laminar-to-turbulent is such that the overall amount of laminar flow remains constant across wings 18 as the speed varies. Thus, as the speed increases, the laminar-to-turbulent transition on wing upper surface 94 moves toward leading edge 60, while the laminar-to-turbulent transition on wing lower surface 96 moves toward trailing edge 62. This transitional action keeps cavitation to a minimum and constant level, thereby minimizing and/or reducing drag. The addition of drag reducing texture 93 to exposed outer surface 90 reduces the impact of the turbulent flow aft of the laminar-to-turbulent transition on wing upper surface 94, and/or wing lower surface 96. Thus, reduction in localized drag and overall drag provides increased performance.

To install the hydrofoil on a motor, one will remove torque tab 44 from the bottom side of the cavitation plate 12. Following removal of the torque tab, one can slide hydrofoil into place on the cavitation plate by positioning the edges of cavitation plate 12 in slots 40, 42 on each side 36, 38 of longitudinal channel 22. Preferably, no gap will exist between closed portion of longitudinal channel 22, i.e. the yoke, 16 and cavitation plate 12 when hydrofoil 10 is completely seated on cavitation plate 12. Following reinstallation of torque tab 44, securing devices are threaded into holes 86 and tightened against the edges of cavitation plate 12. Commonly, one will apply thread locking compound to the thread of holes 86 or securing devices 124.

While the cooperation of securing devices 124 and integrated yoke bridge 110 will adequately retain hydrofoil 10 on cavitation plate 12, one may optionally use one or two additional securing devices passing through hydrofoil 10 and cavitation plate 12. For this portion of the installation, one locates drill bit centering recesses 112 on bottom 34 of hydrofoil 10. The drill bit centering recesses act as a guide for drilling a hole upward through hydrofoil bottom 34, through cavitation plate 12 and hydrofoil top 32. Commonly securing devices 126 will pass downward through hydrofoil 32 through cavitation plate 12 exiting hydrofoil bottom 34. Securing devices 126 will be secured in position with nuts or other conventional fasteners. Ribbed-neck carriage bolts are particularly suited for the application as the head of ribbed-necked carriage bolts will not create unnecessary drag. Further, one will preferably select a drill bit corresponding to the threaded portion of the bolt, thus the ribbed portion of the bolt will engage the interior of the hole allowing one to apply proper torque to the securing nut. Optionally, thread locking compound may be applied to the threads of securing devices 126 and the securing nut or other fastener.

As depicted in FIG. 5, hydrofoil bottom may have three drill bit centering recesses 112. Typically, one will drill two holes using the two drill bit centering recesses 112 designated at area A. However, one may elect to drill only a single hole using drill bit centering recess 112 designated in area B. Due to the cooperation of securing devices 124 within threaded holes 86, and the use of integrated yoke bridge 110, a single securing device 126 positioned in area B will adequately retain hydrofoil 10 to cavitation plate 12.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. A single piece hydrofoil comprising:

a yoke comprising:

a center body defining a longitudinal channel therein, wherein said longitudinal channel has a first and second side and is open to a front of said center body; and a pair of open-ended slots oppositely disposed in each of said channel sides and extending along a substantial length of said sides, wherein said open-ended slots are capable of receiving a cavitation plate of a boat motor;

a pair of wings integrally joined with said yoke and projecting outwardly therefrom, said pair of wings having a leading edge and a trailing edge;

a non-invasive securing device suitable for retaining said hydrofoil on said cavitation plate;

an integrated yoke-bridge spanning said longitudinal channel, said integrated yoke-bridge comprising:

an angled leading face for directing water around said integrated yoke-bridge; and an angled trailing face for allowing water to flow smoothly behind said integrated yoke-bridge, the angled trailing face having a concave left-to-right curvature such that said integrated yoke-bridge is wider near sides thereof, said integrated yoke-bridge having a front-to-back width greater than its top-to-bottom height for reducing drag; and a threaded hole passing from the exterior of said center body and opening into said longitudinal channel, said non-invasive securing device being positioned within said threaded hole, wherein when said hydrofoil is installed on said cavitation plate said non-invasive securing device compressively engages an edge of said cavitation plate thereby retaining said hydrofoil on said cavitation plate.

2. The hydrofoil of claim 1, wherein said integrated yoke-bridge substantially precludes expansion of said longitudinal channel when said hydrofoil is secured to said cavitation plate.

3. The hydrofoil of claim 1, wherein said hydrofoil having a drop from a top of said hydrofoil near its center line to tips of said wings of between zero and two inches.

4. A single piece hydrofoil comprising:

a yoke comprising:

a center body defining a longitudinal channel therein, wherein said longitudinal channel has a first and second side and is open to a front of said center body;

a pair of open-ended slots oppositely disposed in each of said channel sides and extending along a substantial length of said sides, wherein said open-ended slots are capable of receiving a cavitation plate of a boat motor;

a tail section integrally formed with said center body and covering a portion of said longitudinal channel; and a contoured trailing edge defined by said tail section, said contoured trailing edge angling upwardly into a trailing edge peak;

a pair of wings integrally joined with said yoke and projecting outwardly therefrom, said pair of wings having a leading edge and a trailing edge, wherein said trailing edge is seamlessly integrated with said contoured trailing edge of said tail section;

a non-invasive securing device suitable for retaining said hydrofoil on said cavitation plate;

an integrated yoke-bridge spanning said longitudinal channel, said integrated yoke-bridge comprising:

an angled leading face for directing water around said integrated yoke-bridge; and an angled trailing face for allowing water to flow smoothly behind said integrated yoke-bridge, the angled trailing face having a concave left-to-right curvature such that said integrated yoke-bridge is wider near sides thereof, said integrated yoke-bridge having a front-to-back width greater than its top-to-bottom height for reducing drag, said integrated yoke-bridge being configured to preclude expansion of said longitudinal channel when said hydrofoil is secured to said cavitation plate;

a threaded hole passing from the exterior of said center body and opening into said longitudinal channel, said securing device being positioned within said threaded hole, wherein when said hydrofoil is installed on said cavitation plate said securing device compressively engages an edge of said cavitation plate thereby retaining said hydrofoil on said cavitation plate; and no more than three drill bit centering recesses positioned on the bottom of said single piece hydrofoil, said hydrofoil having a drop from a top of said hydrofoil near its center line to tips of said wings of between zero and two inches.

5. A single piece hydrofoil comprising:

a yoke having a center body;

a longitudinal channel defined by said center body, said longitudinal channel having oppositely positioned walls defining oppositely positioned slots capable of receiving a cavitation plate of a boat motor;

a pair of wings having a wing tip, a root, and a trailing edge, each said wing having a cross-sectional configuration of at least one true hydrofoil from said wing tip to said root, wherein said pair of wings are joined to said yoke at said root; and an integrated yoke-bridge spanning said longitudinal channel, said integrated yoke-bridge comprising:

an angled leading face for directing water around said integrated yoke-bridge; and an angled trailing face for allowing water to flow smoothly behind said integrated yoke-bridge, said angled trailing face having a concave left-to-right curvature such that said integrated yoke-bridge is wider near sides thereof, said integrated yoke-bridge having a front-to-back width greater than its top-to-bottom height for reducing drag.

6. The hydrofoil of claim 5, wherein said integrated yoke-bridge substantially precludes expansion of said longitudinal channel when said hydrofoil is secured to said cavitation plate.

7. The hydrofoil of claim 5, further comprising a threaded hole on each side of said center body, said threaded hole passing from the exterior of said center body and opening into said longitudinal channel.

8. The hydrofoil of claim 5, further comprising a threaded hole passing from the exterior of said center body and opening into said longitudinal channel and a securing device positioned within said threaded hole, wherein when said hydrofoil is installed on said cavitation plate said securing device compressively engages an edge of said cavitation plate thereby non-invasively retaining said hydrofoil on said cavitation plate.

9. The hydrofoil of claim 5, said hydrofoil having a drop from a top of said hydrofoil near its center line to tips of said wings of between zero and two inches.

* * * * *